US007656100B2

(12) United States Patent
Deurenberg et al.

(10) Patent No.: US 7,656,100 B2
(45) Date of Patent: Feb. 2, 2010

(54) SYSTEM FOR TEMPERATURE PRIORITISED COLOUR CONTROLLING OF A SOLID-STATE LIGHTING UNIT

(75) Inventors: Peter Hubertus Franciscus Deurenberg, Eindhoven (NL); Christoph Gerard August Hoelen, Eindhoven (NL); Jos Van Meurs, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 562 days.

(21) Appl. No.: 11/572,279

(22) PCT Filed: Jul. 18, 2005

(86) PCT No.: PCT/IB2005/052383

§ 371 (c)(1),
(2), (4) Date: Jan. 18, 2007

(87) PCT Pub. No.: WO2006/011108

PCT Pub. Date: Feb. 2, 2006

(65) Prior Publication Data

US 2008/0007182 A1 Jan. 10, 2008

(30) Foreign Application Priority Data

Jul. 23, 2004 (EP) ..... 04103545

(51) Int. Cl.
*H05B 37/02* (2006.01)

(52) U.S. Cl. ..... 315/307; 315/309

(58) Field of Classification Search ..... 315/307, 315/308, 309, 149, 156, 157, 158, 159, 247
See application file for complete search history.

(56) References Cited

U.S. PATENT DOCUMENTS

| | | | | |
|---|---|---|---|---|
| 5,783,909 | A | 7/1998 | Hochstein | |
| 6,411,046 | B1 * | 6/2002 | Muthu | 315/309 |
| 2002/0097000 | A1 | 7/2002 | Muthu et al. | |
| 2002/0130786 | A1 | 9/2002 | Weindorf | |
| 2002/0171373 | A1 | 11/2002 | Muthu | |
| 2003/0230991 | A1 | 12/2003 | Muthu et al. | |
| 2004/0135524 | A1 | 7/2004 | Gunter et al. | |

FOREIGN PATENT DOCUMENTS

| | | | |
|---|---|---|---|
| EP | 1411751 | A2 | 4/2004 |
| WO | 0247438 | A2 | 6/2002 |
| WO | 03090206 | | 10/2003 |

* cited by examiner

*Primary Examiner*—David Hung Vu

(57) ABSTRACT

The present invention relates to a system (100) for controlling light output of a lighting system. The system (100) comprises a light mixing circuit (116) comprising a plurality of light sources configured to provide a mixed light output (102) and mounted on a heat-sink (202) together with a temperature sensing means and a controller (108) receiving a set-point (110) from a calibration matrix (104) and generating a driving signal (120, 122) for the light mixing circuit (116). The controller (108) comprises a rescale unit (118) configured to measure power of the driving signal (120, 122) and to rescale the driving signal (120, 122) when the power exceeds a predetermined power threshold, and the controller is configured to receive the heat-sink temperature signal (206) and to calculate a junction temperature from the heat-sink temperature signal, and the controller (108) generates the driving signal (120, 122) as a function of the junction temperature.

16 Claims, 4 Drawing Sheets

SYSTEM FOR TEMPERATURE PRIORITISED COLOUR CONTROLLING OF A SOLID-STATE LIGHTING UNIT

FIELD OF INVENTION

This invention relates to a system for temperature prioritised colour controlling of a solid-state lighting (SSL) unit. In particular, this invention relates to a system for controlling junction temperature, output colour and output brightness of an SSL unit, such as an LED luminary.

BACKGROUND OF INVENTION

It is widely known that when the operational or, in particular, the junction temperature of an LED exceeds a certain threshold temperature the LED is permanently damaged, and consequently unable to generate light. Therefore when designing an SSL unit, the thermal design must generally prevent the LEDs of the SSL unit from exceeding this threshold under normal operating conditions.

International patent application no. WO 02/47438 discloses an LED luminary system comprising means for estimating junction temperature by employing a thermal model for the LED light sources and the current input to the LED light sources. The chromaticity coordinates of the LED light sources corresponding to a desired white light are estimated based on the junction temperature, because the characteristics of the LED light sources vary with the temperature. The output brightness of the LED light sources varies exponentially, and the peak wavelength varies linearly with the variation in the junction temperature. When the peak wavelength of the light emitted by the LED varies, the chromaticity coordinates of the LED light sources also vary. Thereby the chromaticity coordinates of the mixed light obtained form the LED luminary is different from the target light when the junction temperature of the LED changes. Hence the LED luminary system comprises a controller utilising the junction temperature estimation for maintaining the target light.

Further article published in SID 00 Digest under the title "Light output feedback solution for RGB LED backlight applications", which is considered the closest prior art, discloses a duty controller varying the duty factor (defined as the ratio between the ON-time pulse width and total pulse width period) of the driving current for an LED array, thereby ensuring that the output chromaticity is constant, and a sensitivity matrix defining the transfer function of the sensor output to LED duty factor drive current.

However neither of the documents cited above evaluate the importance of each of the controllable parameters, namely colour set-point, output brightness and junction temperature. That is, how is the overall quality of the output light of an SSL unit best maintained in the eyes of the receiver.

SUMMARY OF THE INVENTION

An object of the present invention is to provide a system for controlling output light of light sources in an SSL unit in accordance with a temperature measurement, which temperature influences the chromaticity coordinates and output brightness of the SSL unit.

It is a further object of the present invention to provide a system for preventing overheating of light sources in an SSL unit.

It is another object of the present invention to provide a system for prioritising control of a set-point for chromaticity coordinates before output brightness, and for prioritising the junction temperature of the LEDs in an SSL unit before the chromaticity coordinates and/or output brightness.

The above objects together with numerous other objects, advantages and features, which will become evident from below detailed description, are obtained according to a first aspect of the present invention by a system for controlling light output of a lighting system and comprising:

a calibration matrix configured to transfer a desired colour and brightness to a set-point;

a light mixing circuit comprising a plurality of light sources configured to provide a mixed light output;

a controller coupled to said calibration matrix and configured to receive said set-point, and coupled to said light mixing circuit and adapted to generate a driving signal for said light mixing circuit, and said controller comprising a rescale unit configured to measure said driving signal and to rescale said driving signal when said driving signal exceeds a predetermined signal threshold. The system according to the first aspect is characterized in that said light mixing circuit further comprises a temperature sensing means configured to measure temperature of a heat-sink supporting said plurality of light sources and adapted to generate a heat-sink temperature signal, and in that said controller further comprises a calculation unit configured to receive said heat-sink temperature signal and to calculate a junction temperature for each of said plurality of light sources from said heat-sink temperature signal, and is adapted to generate said driving signal as a function of said junction temperature.

The light mixing circuit according to the first aspect of the present invention may further comprise a light sensing means configured to measure a lighting parameter of the mixed light output and to generate a measurement signal. Further, the controller may be configured to receive the measurement signal, and adapted to generate the driving signal additionally based on a comparison between said set-point and said measurement signal.

The system according to the first aspect of the present invention may ensure that whenever the colour of the mixed light output differs from the desired colour in the set-point the controller compensates by adjusting the driving current. However, when the driving current exceeds a predetermined power maximum, the entire set-point is rescaled. Consequently, the colour of the mixed light output is prioritised before the desired brightness level of the mixed light output, and therefore the overall perception of an eye of the change in the mixed light output is minimized, because the human eye is more sensitive to colour changes than brightness changes.

In addition, the system according to the first aspect of the present invention may ensure that the junction temperatures of the light sources are prioritised before the mixed light output so as to restrict light sources from reaching their critical temperatures, while as long as possible to maintain the desired output light prioritising chromaticity before brightness.

The calculation unit according to the first aspect of the present invention may further be configured to forward the junction temperatures to the calibration matrix. The calibration matrix may compensate for spectrum variations caused by changes in the junction temperature in the plurality of light sources by adjusting the set-point appropriately. Further, the calibration matrix may be configured to transfer the desired colour and brightness to a set-point in accordance with junction temperature of the plurality of light sources.

Hence, firstly, the set-point is selected, for example by a user, and causes the rescale unit to provide a driving signal for the light mixing circuit, secondly, as the junction temperature changes potentially causing the brightness and colour of the output light to change, the calibration unit revises the set-point, and, thirdly, if the revised set-point causes the controller to request driving signals from the rescale unit above a signal threshold, such as duty factor maximum, the rescale unit prioritises the colour before the brightness of the output light by rescaling the set-point.

The above objects, advantages and features together with numerous other objects, advantages and features, which will become evident from below detailed description, are obtained according to a second aspect of the present invention by a lighting system comprising a system for controlling light output according to the first aspect of the present invention.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawing, wherein.

DETAILED DESCRIPTION OF PREFERRED EMBODIMENTS

In the following description of the various embodiments, reference is made to the accompanying figures which form a part hereof. It is to be understood that other embodiments may be utilized and structural and functional modifications may be made without departing from the scope of the present invention.

Figure 1:
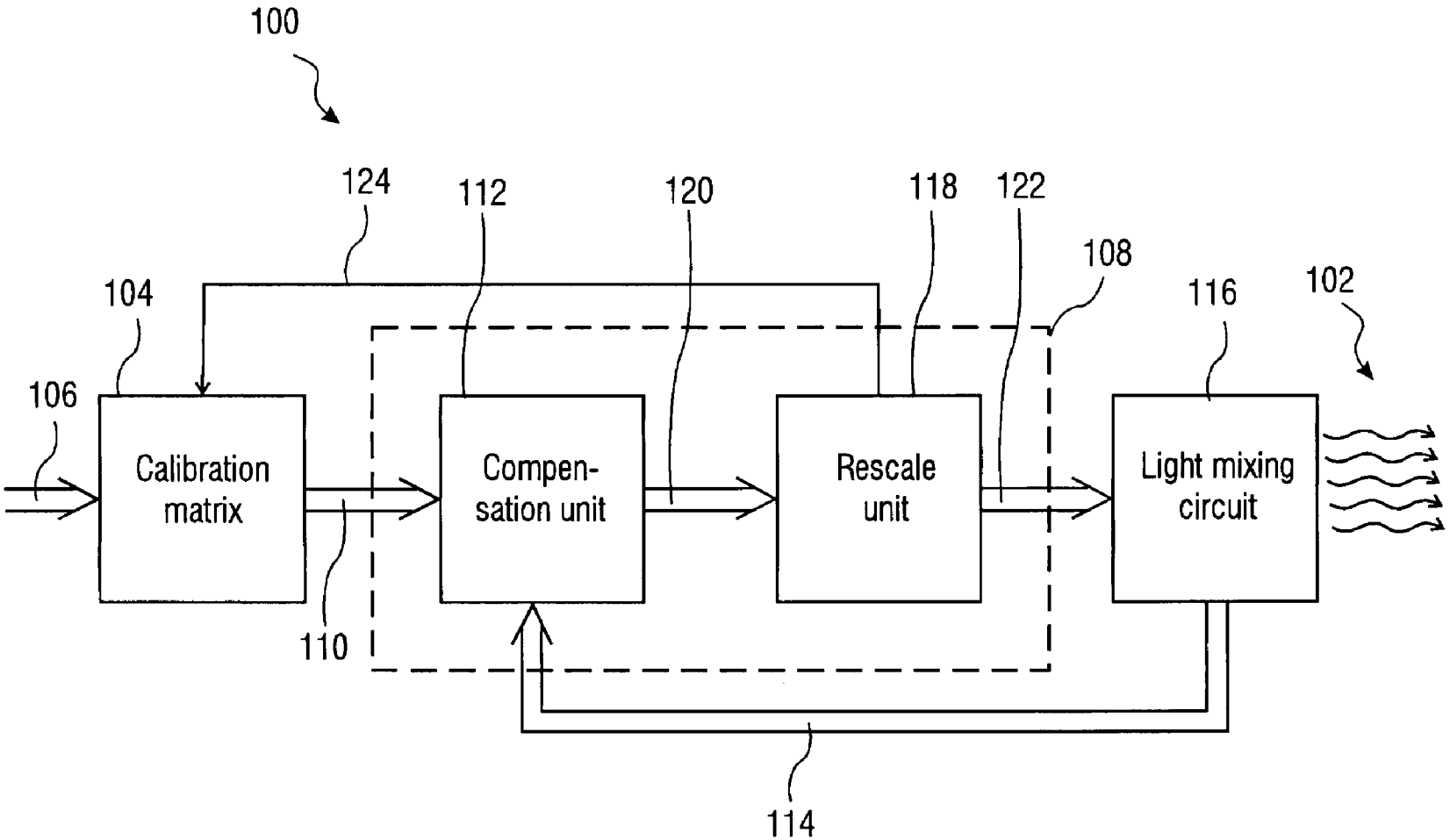
FIG.1 (prior art)
FIG. 1, shows a system according to prior art, which system controls mixed light output by colour sensing.

FIG. 1, shows a prior art system designated in entirety by reference numeral 100, which system 100 controls a mixed light output 102. The system 100 comprises a calibration matrix 104 for transferring desired colour and brightness of the mixed light output 102 into a set-point, which determines configuration of wavelengths of colours to be mixed and colour ratios of the colours to be mixed relative to one another. The desired colour and brightness is input by, for example, a user as chromaticity coordinates and brightness, this input is visualised in FIG. 1 as arrow 106. For every desired colour and brightness of the mixed light output a corresponding set-point is provided in the calibration matrix 104.

The set-point is generally defined by one or more colour signals, such as red, green and blue, these signals each define a colour (wavelength) and ratio (duty factor) of full driving signal.

The set-point is forwarded to a controller designated in entirety by reference numeral 108. Forwarding of the set-point is visualised in FIG. 1 as arrow 110. The controller 108 comprises a compensation unit 112 configured to receive the set-point 110 from the calibration matrix 104 and a light measurement signal 114 from a light mixing circuit 116.

The compensation unit 112 compares the set-point and the light measurement signal 114 and generates an initial driving signal for driving a driver in the light mixing circuit 116. The driving signal is forwarded to a rescale unit 118, which is visualised in FIG. 1 as arrow 120. The rescale unit 118 measures the initial driving signal 120 in order to determine whether the driving signal 120 exceeds a predetermined signal threshold such as duty factor (ratio between "on" period and total period of a pulse width modulation signal) or amplitude. That is, when the initial driving signal 120 comprises red, green and blue light driving components each of the driving components are measured so as to ensure that none of the components exceed the predetermined threshold.

The rescale unit 118 forwards a final driving signal for the driver in the light mixing circuit 116, the final driving signal is visualised in FIG. 1 by arrow 122.

The light mixing circuit 116 is configured to generate mixed light output 102 and comprises a plurality of LED light sources driven in parallel and/or series. The plurality of LED light sources may comprise organic or inorganic LEDs, fluorescent light sources, or in fact any combination thereof.

Figure 2:
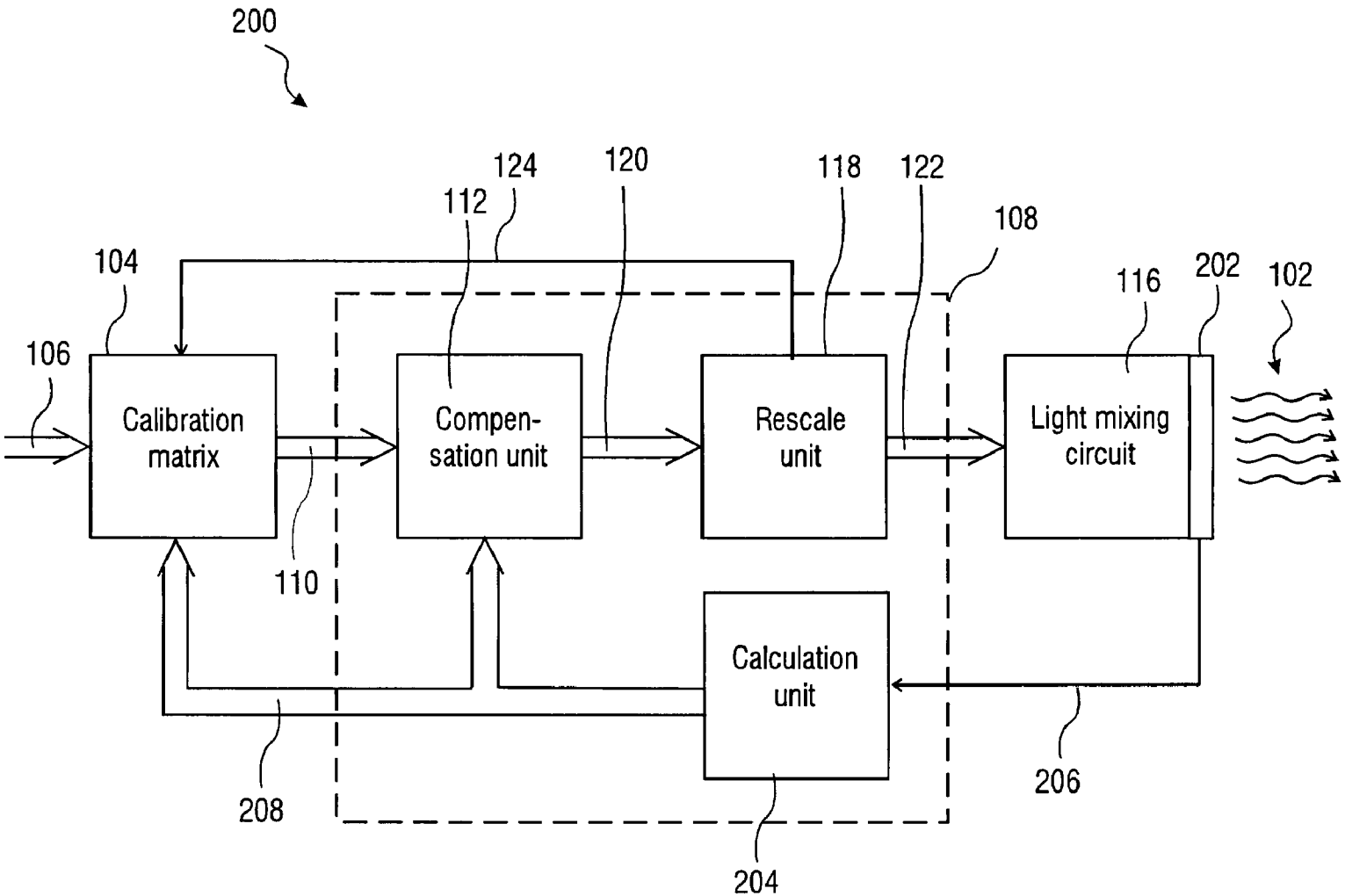
FIG. 2, shows a system according to a first embodiment of the present invention; which system controls mixed light output by junction temperature sensing.

FIG. 2 shows a system designated in entirety by reference numeral 200, which system 200 controls the mixed light output 102. It should be noted that elements of the system 100 described with reference to FIG. 1, which are identical to elements in the system 200, are referenced by like reference numerals in FIG. 2.

The plurality of LED light sources of the light mixing circuit 116 are mounted on a heat-sink 202 comprising a temperature sensor generating a heat-sink temperature signal, which signal is forwarded to a calculation unit, visualised in FIG. 2 by arrow 206.

The calibration matrix 104 is configured to receive the heat-sink temperature signal 206 and to utilise the signal 206 for calculating junction temperature of the plurality of LED light sources in the light mixing circuit 116. The calibration matrix 104 generates a junction temperature signal, which is forwarded to the compensation unit 112 and the calibration matrix, which is visualized by arrow 208.

The compensation unit 112 utilises the junction temperature signal 208 for correcting the set-point 110. That is, when the heat-sink temperature changes, then requirements for driving the plurality of LED light sources in the mixed light circuit 116 changes, and therefore the set-point 110 is compensated for these effects. The set-point 110 may be compensated in a wide number of ways, however, the set-point 110 is advantageously compensated by multiplication by a temperature compensation factor, which is established from the junction temperature signal 208. The junction temperature factor may have any size between zero and indefinite but is generally in the range between zero and two, and normally close to one.

The calibration matrix 104 utilises the junction temperature signal 208 for adjusting the set-point 110 so as to account for spectrum variations caused by changes in the junction temperature of the plurality of LED light sources. In general, LED light outputs tend to decrease with increasing junction temperature thus requiring an increased driving power to maintain desired colour and brightness of the mixed light output 102.

The compensation unit 112 thus generates a initial driving signal 120 based on the compensated set-point 110. In case, the driving requirements exceed the predetermined threshold, the rescaling unit 118 will rescale the initial driving signal.

Similarly, as described above and with reference to FIG. 1, the rescale unit 118 is configured to receive the initial driving signal 120 and to ensure that the initial driving signal 120 does not exceed a predetermined threshold.

In case the initial driving signal 120 exceeds the threshold, the rescale unit 118 rescales all driving components by a rescale factor to ensure that none of the driving components exceed the threshold while maintaining the ratios between the driving components of the driving signal. In addition, the rescale unit 118 forwards the rescale factor signal 124 to the calibration matrix 104 enabling the calibration matrix 104 to rescale the set-point.

For example, if the initial driving signal 120 is a pulse width modulation current driving signal comprising three separate colour component signals (e.g. red, green and blue) and the threshold is a duty factor value, such as 95%, 90%, 85%, 80% or even lower, then, as one of the colour component signals requires adjustment for obtaining a desired mixed light output, and thereby causing a required duty factor value above 95% of said one of the colour component signals, the rescale unit 118 rescales all three colour component signals by the same rescale factor in such a way that the said one of the colour component signals obtains a duty factor value below 95% and the other colour component signals are rescaled similarly. This rescaling will obviously reduce the brightness of the mixed light output, however as stated before, the human eye is more sensitive to colour changes rather than brightness changes and therefore maintaining colour is prioritised before maintaining brightness.

In case the heat-sink temperature and therefore the junction temperature rises, the compensation unit 112 multiplies the set-point 110 with the temperature compensation factor thus increasing the required power (or duty factor as the case may be) of the initial driving signal 120. However, the rescale unit 118 will rescale the initial driving signal 120 if the initial driving signal 120 exceeds the predetermined threshold thereby ensuring that the desired colour of the mixed light output 102 is prioritised before desired brightness of the mixed light output 102.

Figure 3:
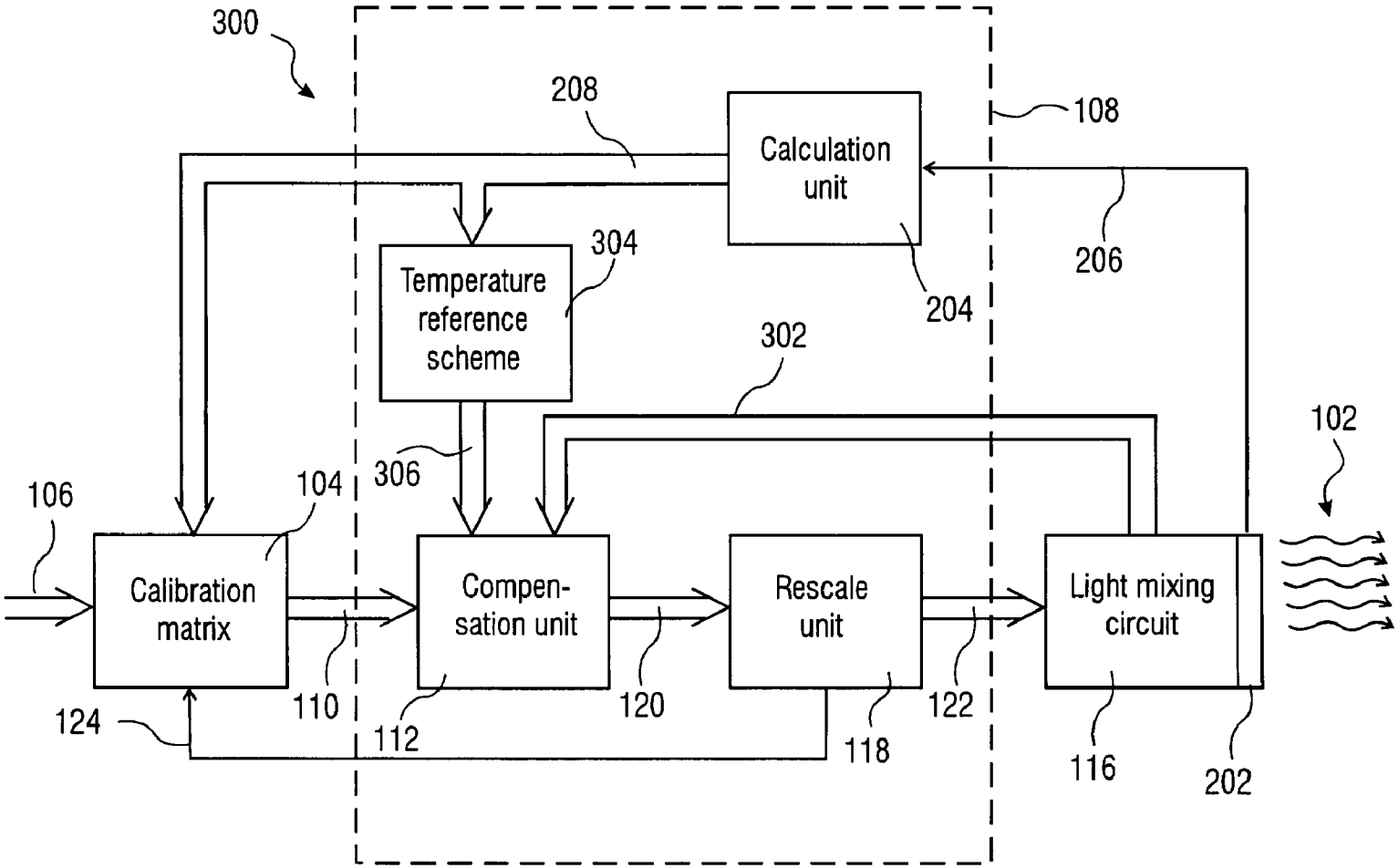
FIG. 3, shows a system according to a second embodiment of the present invention, which system controls mixed light output by colour and junction temperature sensing.

FIG. 3 shows a system designated in entirety by reference numeral 300, which system 300 controls mixed light output 102 in accordance with desired colour of the mixed light output 102 and the heat-sink temperature of the plurality of LED light sources in the light mixing circuit 116. As before like elements in the systems 100, 200 and 300 are designated with like reference numerals in FIG. 3.

The light mixing circuit 116 comprises a sensor unit having light sensing means such as a photosensitive diode or transistor. The sensor unit generates a flux measurement signal, which is forwarded to the compensation unit 112, visualized by arrow 302.

The calculation unit 204 in system 300 is configured to receive the heat-sink temperature signal 206 and to utilise this signal 206 for calculating junction temperature of the plurality of LED light sources in the light mixing circuit 116. The calculation unit 404 is further configured to generate the junction temperature signal 208 based on the calculated junction temperature. The junction temperature signal 208 is forwarded to the calibration matrix 104 and a temperature reference scheme unit 406.

The temperature reference scheme unit 304, comprising colour and brightness references for a plurality of junction temperatures for each colour used in the generation of the mixed light output 102, provides a conversion of the junction temperature signal 208 to a flux signal 306, which is forwarded by the temperature reference scheme unit 304 to the compensation unit 112.

In case the temperature of the light sensing means in the sensor unit changes so does the sensitivity of the light sensing means. These changes may be accounted for in the temperature reference scheme unit 304 by performing an additional temperature measurement in the light mixing circuit 116.

The compensation unit 112 is configured to receive the flux measurement signal 302 (current state) and the flux signal 306 (reference) and compares the flux measurement signal (302) and said flux signal (306) to establish a differential flux compensation factor and multiplies the set-point (112) with the flux compensation factor. The compensation unit 112 generates a initial driving signal 120 based on this multiplication and forwards the initial driving signal 120 to the rescale unit 118.

As described with reference to FIGS. 1 through 2 the rescale unit 118 is configured to receive the initial driving signal 120 and to determine whether the initial driving signal 120 exceeds a predetermined threshold. The initial driving signal 120 is rescaled by the rescale unit 118, whenever the initial driving signal 120 exceeds the predetermined threshold and, in addition, the rescale unit 118 forwards the rescale factor signal 124 to the calibration matrix 104, which in turn uses the rescale factor signal 124 to rescale the set-point of the calibration matrix 104. Hence the rescale unit 118 prioritises colour before brightness, as it actively decreases the power (or duty factor as may be) of the driving signal 122 when any component of the initial driving signal 120 exceeds the predetermined threshold.

The calibration matrix 104 according to the second embodiment of the present invention comprises data for set-point versus junction temperature for each colour used in the generation of the mixed light output 102. The calibration unit 104 is configured to receive the junction temperature signal 208 and utilises this signal for adjusting the set-point 110 in accordance with changes in the junction temperature, which causes spectrum variations of the mixed light output 102.

Figure 4:
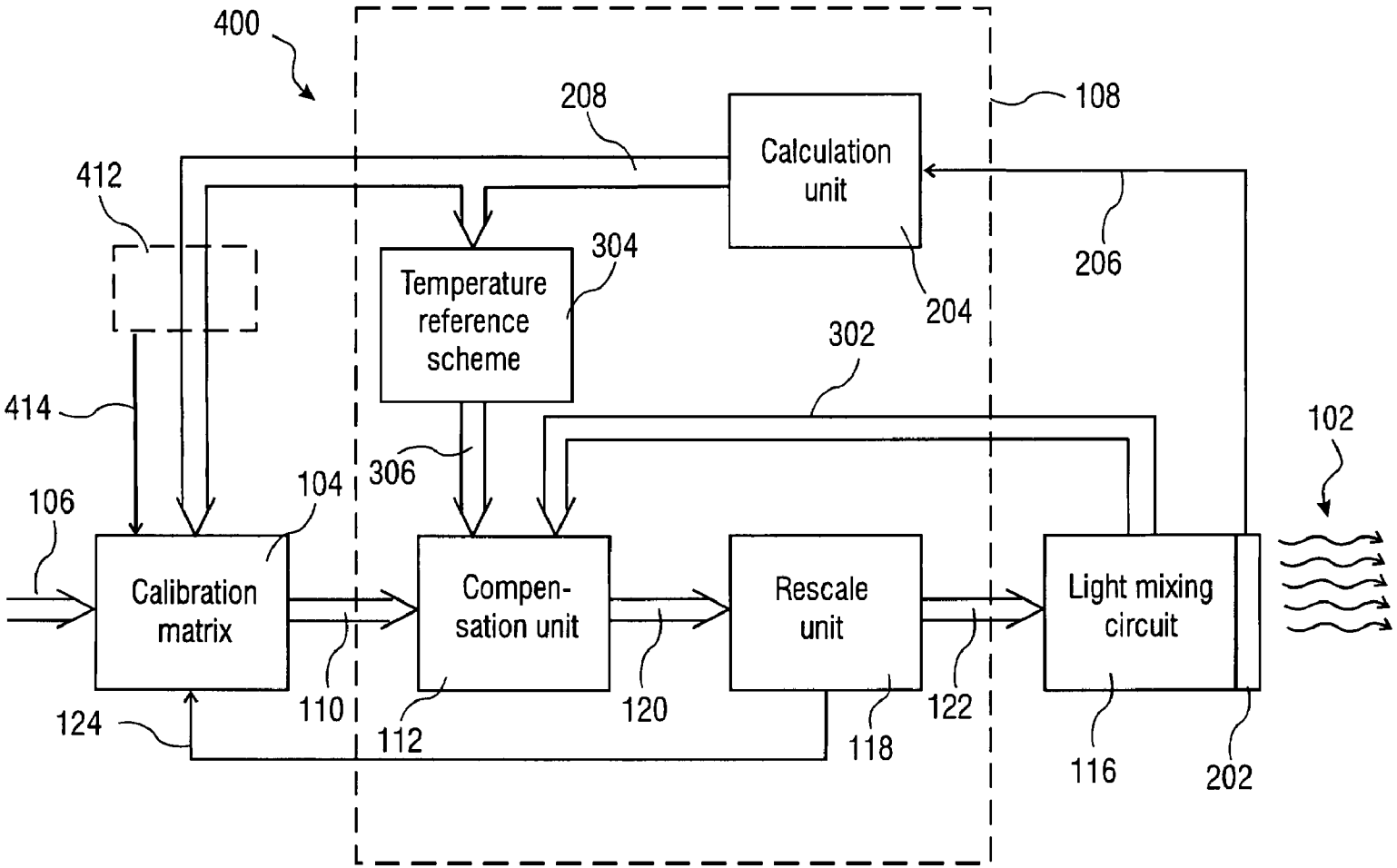
FIG. 4, shows a system according to a third embodiment of the present invention, which system controls mixed light output by colour and junction temperature sensing and comprises a temperature threshold unit.

FIG. 4 shows a system designated in entirety by reference numeral 400, which system 400 controls the mixed output light 102 and temperature induced spectrum variations in the colours in the mixed output light 102. As before like elements in the systems 100, 200, 300 and 400 are designated with like reference numerals in FIG. 4.

The system 400 comprises all elements of system 300 described with reference to FIG. 3 and in addition comprises a temperature threshold unit 412 configured to receive the junction temperature signal 208 in order to determine whether the junction temperature of any the plurality of LED light sources is approaching an unacceptable level.

In case the temperature threshold unit 412 determines that the junction temperature of any of the plurality of LED light sources is above a temperature threshold, the unit 412 forwards a instruction signal, visualized in FIG. 4 by arrow 414, to the calibration matrix 104. The instruction signal 414 instructs the calibration matrix 104 to reduce the desired brightness of the mixed light output 102. Hence the temperature threshold unit 412 prioritises the junction temperature above desired brightness.

The invention claimed is:

1. A system (100) for controlling light output of a lighting system and comprising:

a calibration matrix (104) configured to transfer a desired colour and brightness to a set-point (110);

a light mixing circuit (116) comprising a plurality of light sources configured to provide a mixed light output (102);

a controller (108) coupled to said calibration matrix (104) and configured to receive said set-point (110), and coupled to said light mixing circuit (116) and adapted to generate a driving signal (120, 122) for said light mixing circuit (116), and said controller (108) comprising a rescale unit (118) configured to measure said driving signal (120, 122) and to rescale said driving signal (120, 122) when said driving signal (120) exceeds a predetermined signal threshold, and characterized in that said light mixing circuit (116) further comprises a temperature sensing means configured to measure temperature of a heat-sink (202) supporting said plurality of light sources and adapted to generate a heat-sink temperature signal (206), and in that said controller (108) further comprises a calculation unit (204) configured to receive said heat-sink temperature signal (206) and to calculate a junction temperature for each of said plurality of light sources from said heat-sink temperature signal, and is adapted to generate said driving signal (120, 122) as a function of said junction temperature.

2. A system according to claim 1, wherein said calculation unit (204) is adapted to generate a junction temperature signal (208).

3. A system according to claim 2, wherein said controller (108) further comprises a compensation unit (112) configured to receive said set-point (110) and to receive said junction temperature signal (208), and adapted to generate an initial driving signal (120) based on a temperature compensation of said set-point (112) relative to said junction temperature signal (114) and to forward said initial driving signal (120) to said rescale unit (118).

4. A system according to claim 3, wherein said temperature compensation comprises calculation of a temperature compensation factor and multiplication of said set-point (110) by said temperature compensation factor.

5. A system according to claim 4, wherein said temperature compensation factor is in a range between 0 and 2.

6. A system according to claim 2, wherein said calibration matrix (104) is configured to receive said junction temperature signal (208), and adapted to adjust said set-point (110) in accordance with said junction temperature signal (208).

7. A system according to claim 1, wherein said light mixing circuit further comprises a photosensitive sensor configured to measure flux of said mixed light output (102) and to generate a flux measurement signal (302).

8. A system according to claim 7, wherein said compensation unit (112) is configured to receive said flux measurement signal (302) and adapted to generate said driving signal (120, 122), additionally, based on a flux compensation of said set-point (112) relative to said flux measurement signal (302).

9. A system according to claim 8, wherein said flux compensation comprises calculation of a flux compensation factor and multiplication of said set-point (110) by said flux compensation factor.

10. A system according to claim 9, wherein said flux compensation factor is in a range between 0 and 2.

11. A system according to claim 1, wherein said rescale unit (118) is further configured to rescale said set-point (110) in said calibration matrix (104) by a rescale factor (124) when said driving signal (120) exceeds said predetermined signal threshold.

12. A system according to claim 1, wherein said controller (108) further comprises a temperature reference scheme unit (304) configured to receive said junction temperature signal (208) and adapted to generate a flux signal (306) based on said junction temperature signal (208) and to forward said flux signal (306) to said compensation unit (112).

13. A system according to claim 12, wherein said compensation unit (112) is adapted to generate an initial driving signal (120) based on a comparison of said flux measurement signal (302) and said flux signal (306) establishing a differential flux compensation factor and on multiplying said set-point (112) with said flux compensation factor.

14. A system according to claim 1 further comprising a temperature threshold unit (412) configured to receive said junction temperature signal (208), and adapted to determine whether junction temperature of any of said plurality of light sources is above a predetermined temperature threshold and to generate an instruction signal (414) to said calibration matrix (104) when said predetermined temperature threshold is exceeded.

15. A system according to claim 14, wherein said calibration matrix (104) on reception of said instruction signal (414) reduces said set-point (110).

16. A lighting system comprising a system for controlling light according to claim 1.

* * * * *